US008302757B1

(12) United States Patent
Angus et al.

(10) Patent No.: US 8,302,757 B1
(45) Date of Patent: Nov. 6, 2012

(54) MEDIA RECYCLER

(75) Inventors: Robin Angus, Fife (GB); Gordon Walker, Perthshire (GB)

(73) Assignee: NCR Corporation, Duluth, GA (US)

( * ) Notice: Subject to any disclaimer, the term of this patent is extended or adjusted under 35 U.S.C. 154(b) by 0 days.

(21) Appl. No.: 12/878,059

(22) Filed: Sep. 9, 2010

(51) Int. Cl.
*G07F 7/04* (2006.01)

(52) U.S. Cl. ..... 194/206; 242/528; 271/176; 271/216

(58) Field of Classification Search ..... 194/206, 194/207; 242/528; 271/176, 216; 209/534
See application file for complete search history.

(56) References Cited

U.S. PATENT DOCUMENTS 7,494,122 B2 * 2/2009 Spinetti ..... 271/216
7,654,485 B2 * 2/2010 Rossel et al. ..... 242/528
7,780,111 B2 * 8/2010 Elbel ..... 242/528
2002/0101023 A1 * 8/2002 Saltsov et al. ..... 271/3.21
2002/0113160 A1 * 8/2002 Niioka et al. ..... 242/528
2004/0093117 A1 * 5/2004 Daout et al. ..... 700/231
2005/0078015 A1 * 4/2005 Ferran et al. ..... 341/11
2007/0221776 A1 * 9/2007 Rossel et al. ..... 242/528

* cited by examiner

*Primary Examiner* — Jeffrey Shapiro
(74) *Attorney, Agent, or Firm* — Paul W. Martin

(57) ABSTRACT

A media storage unit for a media recycler is described. The media storage unit comprises: a first rotary storage device; a second rotary storage device aligned with the first rotary storage device; and storage tape wound around each of the first and second storage devices and including calibration marks disposed along one side of the storage tape. The media storage unit also comprises a sensor for detecting the calibration marks; an entry/exit port between the first and second rotary storage devices through which media items can be inserted or removed; and a controller operable to rotate the first and/or second storage devices to move the storage tape forwards or backwards while sensing the calibration marks to locate either (i) a media item of the desired type for a dispense transaction, or (ii) a space on the storage tape of the required type for a deposit transaction.

14 Claims, 5 Drawing Sheets

MEDIA RECYCLER

FIELD OF INVENTION

The present invention relates to a media recycler.

BACKGROUND OF INVENTION

Media recyclers receive media deposited by a first customer as part of one transaction, and then subsequently dispense the deposited media to another customer as part of another transaction. A common type of media used in such recyclers is banknotes.

One advantage of banknote recyclers is that they reduce the number of banknote replenishment operations required, thereby saving money for the owner or operator of the media recycler.

There are also disadvantages associated with banknote recyclers. For example, recyclers need to be able to receive and dispense multiple denominations, each denomination typically needing its own store and pathway. The multiple pathways (including the associated transport components and gates) that are required to store and retrieve different denominations of banknotes typically result in either a high cost or a low reliability for such banknote recyclers. Some applications, such as the retail industry and the vending industry, require low cost banknote recyclers that are reliable.

SUMMARY OF INVENTION

Accordingly, the invention generally provides methods, systems, apparatus, and software for an improved media recycler.

In addition to the Summary of Invention provided above and the subject matter disclosed below in the Detailed Description, the following paragraphs of this section are intended to provide further basis for alternative claim language for possible use during prosecution of this application, if required. If this application is granted, some aspects may relate to claims added during prosecution of this application, other aspects may relate to claims deleted during prosecution, other aspects may relate to subject matter never claimed. Furthermore, the various aspects detailed hereinafter are independent of each other, except where stated otherwise. Any claim corresponding to one aspect should not be construed as incorporating any element or feature of the other aspects unless explicitly stated in that claim.

According to a first aspect there is provided a media storage unit for a media recycler, the media storage unit comprising:

a first rotary storage device;

a second rotary storage device aligned with the first rotary storage device;

storage tape wound around each of the first and second storage devices and including a plurality of calibration marks disposed therealong;

a sensor for detecting the calibration marks;

an entry/exit port between the first and second rotary storage devices through which media items can be inserted or removed; and a controller operable to rotate either the first or second storage devices to move the storage tape forwards or backwards while sensing the calibration marks to locate either (i) a media item of the desired type for a dispense transaction, or (ii) a space on the storage tape of the required type for a deposit transaction.

The media storage unit may further comprise first and second auxiliary tape stores.

The first auxiliary tape store may include first auxiliary tape wound around the first auxiliary tape store and extending to, and wound around, the first rotary storage device, so that media items are stored on the first rotary storage device between the first auxiliary tape and the storage tape.

The second auxiliary tape store may include second auxiliary tape wound around the second auxiliary tape store and extending to, and wound around, the second rotary storage device, so that media items are stored on the second rotary storage device between the second auxiliary tape and the storage tape.

The entry/exit port may include a gate moveable by the controller between two positions: (i) a transport position, at which the gate is parallel to a portion of the storage tape adjacent the gate, and (ii) an entry/exit position, at which the gate is transverse to the portion of the storage tape adjacent the gate.

The transport position may be used to transfer a stored media item from the first rotary storage device to the second rotary storage device.

The entry/exit position may be used to allow a media item to be inserted between the storage tape and the first (or second) auxiliary tape.

The entry/exit position may also be used to allow a media item to be removed from between the storage tape and the first (or second) auxiliary tape.

The entry/exit port may include a gate moveable by the controller between three positions: (i) a transport position, at which the gate is parallel to a portion of the storage tape adjacent the gate, (ii) an entry position, at which the gate is transverse to the portion of the storage tape adjacent the gate and a lower part thereof is closer to the first rotary storage device than to the second rotary storage device, (iii) an exit position, at which the gate is transverse to the portion of the storage tape adjacent the gate and a lower part thereof is closer to the second rotary storage device than to the first rotary storage device.

The entry/exit port may include a plurality of rollers for guiding the storage tape, the first auxiliary tape, and the second auxiliary tape, and maintaining these tapes in tension.

The calibration marks may be optical, magnetic, and/or structural. Examples of a structural mark include: an aperture in the storage tape, a change in thickness of the storage tape, or the like.

The calibration marks may use an encoding scheme to indicate a media type to be stored at that point. Alternatively, the calibration marks may comprise a set of different marks, each mark corresponding to a defined number of storage locations for a media item. For example, the set of different types of marks may comprise five different marks.

The calibration marks may be delineated on an outer surface of the storage tape.

The controller may be arranged to store a mapping of the types of media item stored at each different calibration mark.

The calibration marks may identify each position uniquely, or at least with reference to adjacent positions. These calibration marks may be mapped to a denomination value in a mapping (such as a look-up table, a database, or the like) in the controller. This would allow complete and dynamic flexibility for which denominations are stored in which physical locations.

A combination of long and short blocks may be used to encode the type of media item to be stored at a storage location on the storage tape. For example, two long blocks then a short block may indicate that the storage location is for a one dollar bill; a long block, a short block, then a long block may indicate that the storage location is for a ten dollar bill; a short block, a long block, then another long block may indicate that the storage location is for a five dollar bill; and so on.

Alternatively, a combination of dots may be used to encode the type of media item to be stored at a storage location. For example, a calibration mark may comprise a single dot, and a single one dollar banknote may be stored at that location; another calibration mark may comprise two dots, and a single five dollar banknote may be stored at that location; yet another calibration mark may comprise three dots, and a single ten dollar banknote may be stored at that location. There may be unequal numbers of different calibration marks, for example, more single dots than two dots, more two dots than three dots, and the like.

Many different encoding schemes are known to those of skill in the art, and any convenient scheme may be used. The scheme used may be influenced by the speed of travel of the storage tape, the resolution of the sensor, and the like.

The sensor may comprise an optical sensor, an ultrasonic sensor, a magnetic sensor, or any other convenient sensor.

The sensor may include a detector for detecting the presence of a media item at a storage location. The detector may comprise a transmitter and receiver for detecting a reflection from a media item.

The sensor may also measure a position of a media item relative to the closest calibration mark thereto. This measurement may be used to detect any drift in the location of the media item relative to the calibration mark nearest to it. If the media item has drifted over time, then the media item may be removed and re-inserted to ensure that it is located within a defined tolerance of the nearest calibration mark, or between two adjacent calibration marks.

According to a second aspect there is provided a media recycler including the media storage unit of the first aspect.

The media recycler may further comprise a motor for rotating the rotary storage devices and the auxiliary tape stores.

The media recycler may further comprise a media validator. The media validator may comprise a banknote validator.

The media recycler may further comprise a media separator for receiving a stack of media items at a media inlet, and separating the stack into individual media items, which are then transported to the media validator.

The media recycler may further comprise an overflow store. The overflow store may be used for receiving media items in the event that the first and second rotary storage devices are full, or if the media items are not suitable for recycling such as coupons, captured counterfeit banknotes, soiled banknotes, torn banknotes, or the like.

The media recycler may further comprise an escrow for temporarily holding media items until a customer confirms that he/she wants to proceed with a transaction. The escrow may comprise a further rotary storage device, a stacking compartment, or the like.

Where a rotary storage device is used for the escrow, the controller may transfer the contents of the escrow to the first and second rotary storage devices subsequent to a customer transaction in which the media items in the escrow were deposited. By transferring the media items after a transaction has been completed, the recycler does not need to operate in real time, so a slower storage system can be used.

According to a third aspect there is provided a method of storing media items in a media recycler, the method comprising:

receiving a media item from a media item validator;

rotating a first rotary storage device and/or a second rotary storage device aligned with the first rotary storage device to move storage tape wound around each of the first and second storage devices;

sensing calibration marks disposed along a surface of the storage tape to identify a position on the storage tape corresponding to a media item category associated with the received media item type;

aligning the identified position with an entry/exit port; and inserting the received media item into the entry/exit port.

The step of inserting the received media item into the entry/exit port may comprise the further step of moving a gate in the entry/exit port to an entry position at which the gate is transverse to a portion of the storage tape adjacent the gate and a lower part thereof is closer to the first rotary storage device than to the second rotary storage device.

The step of rotating a first rotary storage device and/or a second rotary storage device may further comprise, moving a gate in the entry/exit port to a transport position at which the gate is parallel to a portion of the storage tape adjacent the gate, so that media items stored in the first rotary storage device may be transferred past the entry/exit port to the second rotary storage device.

According to a fourth aspect there is provided a method of dispensing media items from a media recycler, the method comprising:

rotating a first rotary storage device and/or a second rotary storage device aligned with the first rotary storage device to move storage tape wound around each of the first and second storage devices;

sensing calibration marks disposed along a surface of the storage tape to identify a position on the storage tape corresponding to a media item category associated with a media item required to fulfill a dispense transaction;

aligning the identified position with an entry/exit port; and transporting a media item stored at the identified position through the entry/exit port towards a dispense slot.

The step of transporting a media item stored at the identified position through the entry/exit port towards a dispense slot may comprise the further step of moving a gate in the entry/exit port to an exit position at which the gate is transverse to a portion of the storage tape adjacent the gate and a lower part thereof is closer to the second rotary storage device than to the first rotary storage device.

The step of rotating a first rotary storage device and/or a second rotary storage device may further comprise, moving a gate in the entry/exit port to a transport position at which the gate is parallel to a portion of the storage tape adjacent the gate, so that media items stored in the first rotary storage device may be transferred past the entry/exit port to the second rotary storage device.

According to a fifth aspect there is provided a self-service terminal including a media recycler according to the second aspect.

The self-service terminal (SST) may be an automated teller machine (ATM), an information kiosk, a financial services centre, a bill payment kiosk, a lottery kiosk, a postal services machine, a check-in and/or check-out terminal such as those used in the retail, hotel, car rental, gaming, healthcare, and airline industries, and the like.

This aspect allows a self-service terminal, such as a retail self-checkout terminal, to be provided that includes a low cost recycler that can handle multiple denominations without requiring a large amount of space.

According to a sixth aspect there is provided a method of storing a media item in a media recycler, the method comprising:

moving storage tape in the media recycler;

reading a first calibration mark adjacent to a storage location on the storage tape;

ascertaining if the first calibration mark indicates that the storage location is suitable for receiving a media item of the type to be stored;

inserting the media item into the storage location in the event that the storage location is suitable for receiving the media item to be stored;

moving the storage tape so that a second calibration mark can be read in the event that the first calibration mark indicates that the storage location is not suitable for receiving the media item to be stored.

The second calibration mark may be adjacent to the first calibration mark, or there may be calibration marks between the first and second calibration marks. In other words, the method may skip calibration marks, for example, if a controller can ascertain where a desired calibration mark is located based on the first calibration mark.

According to a seventh aspect there is provided a method of retrieving a media item from a media recycler, the method comprising:

moving storage tape in the media recycler;

reading a first calibration mark adjacent to a storage location on the storage tape;

ascertaining if the first calibration mark indicates that the storage location is suitable for storing a media item of the type to be retrieved;

ascertaining if a media item of the type to be retrieved is located within the storage location;

removing the media item from the storage location in the event that the storage location is suitable for receiving the media item to be retrieved and stores the media item to be retrieved; and moving the storage tape so that a second calibration mark can be read in the event that the first calibration mark indicates that the storage location is not suitable for storing the media item to be retrieved, or does not store the media item to be retrieved.

According to an eighth aspect there is provided storage tape for use with a media recycler, the storage tape comprising:

a series of calibration marks disposed therealong, the calibration marks being disposed in a pattern to define one or more storage locations between adjacent calibration marks.

For clarity and simplicity of description, not all combinations of elements provided in the aspects recited above have been set forth expressly. Notwithstanding this, the skilled person will directly and unambiguously recognize that unless it is not technically possible, or it is explicitly stated to the contrary, the consistory clauses referring to one aspect are intended to apply mutatis mutandis as optional features of every other aspect to which those consistory clauses could possibly relate.

These and other aspects will be apparent from the following specific description, given by way of example, with reference to the accompanying drawings.

DETAILED DESCRIPTION

Figure 1:
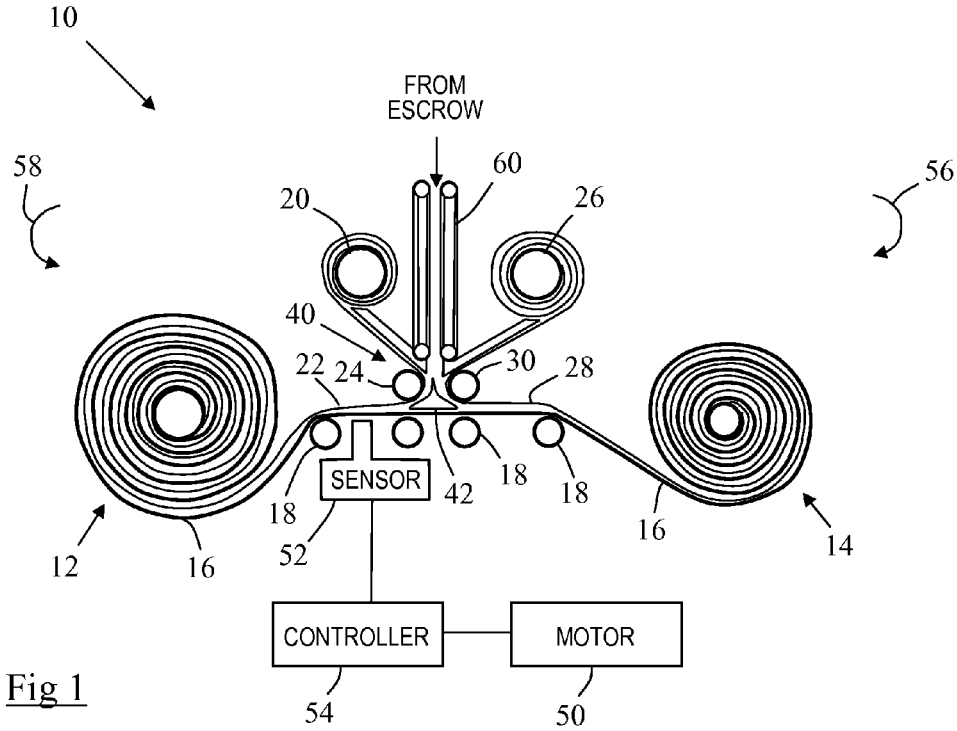
FIG. 1 is a schematic diagram of a media storage unit according to one embodiment of the present invention.

Reference is first made to FIG. 1, which is a schematic diagram of a media storage unit 10 according to one embodiment of the present invention. In this embodiment, the media storage unit 10 is a banknote storage unit. The banknote storage unit 10 comprises: a first rotary storage device 12 aligned with a second rotary storage device 14, and storage tape 16 wound around each of these storage devices 12,14, and maintained in tension by rollers 18.

The banknote storage unit 10 further comprises a first auxiliary tape store 20, which supplies first auxiliary tape 22 for co-operating with the storage tape 16 stored on the first rotary storage device 12. As the storage tape 16 is wound onto the first rotary storage device 12, the first auxiliary tape 22 is also wound onto the first rotary storage device 12, and media items (in the form of banknotes) can be stored between the wound storage tape 16 and the first auxiliary tape 22. A first auxiliary roller 24 is provided to maintain tension on the first auxiliary tape 22.

The banknote storage unit 10 also comprises a second auxiliary tape store 26, which supplies second auxiliary tape 28 for co-operating with the storage tape 16 stored on the second rotary storage device 14. As the storage tape 16 is wound onto the second rotary storage device 14, the second auxiliary tape 28 is also wound onto the second rotary storage device 14, and media items (in the form of banknotes) can be stored between the wound storage tape 16 and the second auxiliary tape 28. A second auxiliary roller 30 is provided to maintain tension on the second auxiliary tape 28.

The banknote storage unit 10 also comprises an entry/exit port, shown generally by arrow 40. The entry/exit port 40 includes a pivoting gate 42 moveable between two positions, as will be described below.

Motors 50 are provided in the banknote storage unit 10 to rotate the first and second rotary devices 12,14 and the first and second auxiliary tape stores 20,26 to advance or rewind the storage tape 16.

The storage tape 16 has an inner surface, which is used to contact banknotes, and an outer surface, which includes a series of calibration marks (not shown in FIG. 1), as will be described in more detail below.

A sensor 52 is provided to read the calibration marks on the storage tape 16 as the storage tape 16 is advanced (towards rotary storage device 14) or rewound (towards rotary storage device 12). The sensor 52 also ascertains if a banknote is stored at the particular storage location being sensed. This is implemented using an optical or ultrasonic source directed to an area near to the storage tape 16 (that would be occupied by a banknote if one was present) and measuring any reflections from that area. If no banknote is present, then only a weak reflection would be measured; if a banknote is present, then a strong reflection would be measured.

A controller 54 is provided to activate the motors 50 and to control the pivoting gate 42 (using a solenoid (not shown)). The controller 54 also identifies calibration marks read by the sensor 52 and ascertains what banknote is, or should be, stored at each calibration mark.

The motors 50 are operable to rotate the storage devices 12,14 and the auxiliary tape stores 20,26 in both the clockwise direction (shown by curved arrow 56) and in the anticlockwise direction (shown by curved arrow 58).

The banknote storage unit 10 also includes a transport section 60 for conveying banknotes from an external escrow (not shown in FIG. 1) to the entry/exit port 40. The transport section 60 includes stretchable endless belts disposed within skid plates located on opposing sides of the transport section 60.

Figure 2A:
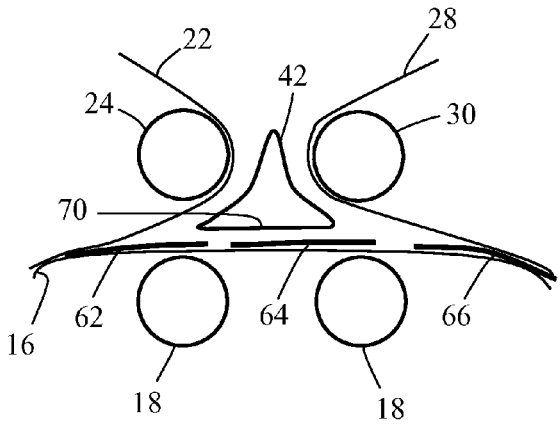
FIGS. 2A and 2B illustrate a part (the pivoting gate) of the media storage unit of FIG. 1 in two different positions (a transport position and a media entry/exit position)
Figure 2B:
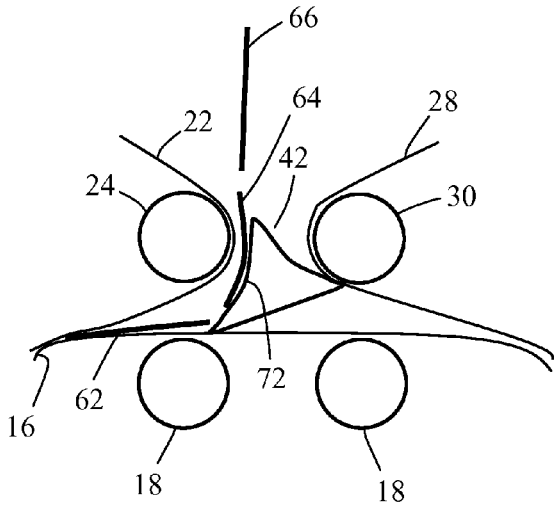

Reference will now also be made to FIGS. 2A and 2B, which show the pivoting gate 42 in two different positions. The controller 54 is operable to activate the solenoid to move the pivoting gate 42 between these two positions.

The first position (as shown in FIG. 2A) is the transport position (also shown in FIG. 1), at which the gate 42 is generally parallel to a portion of the storage tape 16 adjacent the pivoting gate 42. FIG. 2A illustrates three successive banknotes 62,64,66 at different points on a transport path with the pivoting gate 42 in the transport position. A lower surface 70 of the pivoting gate 42 ensures that the banknotes 62,64,66 are transported from the first rotary storage device 12, across the gate 42, to the second rotary storage device 14.

The second position (as shown in FIG. 2B) is the entry/exit position, at which the gate 42 is transverse to the portion of the storage tape 16 adjacent the gate 42 so that a side portion 72 of the gate 42 acts to guide banknotes 62,64,66 between the first rotary storage device 12 and the external escrow (not shown).

Figure 3:
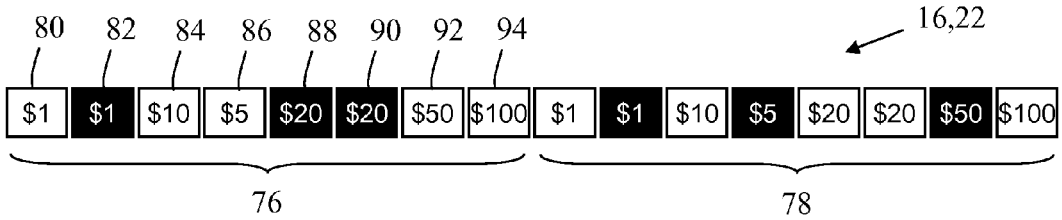
FIG. 3 is a pictorial diagram of a part (the storage tape) of the media storage unit of FIG. 1, illustrating different categories of media items stored thereon.

Reference will now be made to FIG. 3, which is a pictorial diagram of the storage tape 16, illustrating different categories of banknotes stored thereon. The storage tape 16 is marked with calibration marks at each storage location. A storage location is slightly larger than the length of a banknote to be accommodated within that storage location.

The storage tape 16 is delineated into sets along its entire length. Each set is identical to all of the other sets on the storage tape 16, and comprises a plurality of storage locations. The controller 54 is programmed with the configuration of the sets so that the controller 54 is aware of the order that banknotes are stored in the set.

FIG. 3 shows two sets 76,78, each comprising eight storage locations. Only the first eight storage locations 80 to 94 are unique, thereafter, the pattern repeats, so that storage locations nine to sixteen are identical to storage locations one to eight 80 to 94. Each of the first two locations 80,82 is used to store a one dollar bill, the third location 84 is used to store a ten dollar bill, the fourth location 86 is used to store a five dollar bill, the fifth and sixth locations 88,90 are each used to store a twenty dollar bill, the seventh location 92 is used to store a fifty dollar bill, and the eighth location 94 is used to store a one hundred dollar bill.

Those storage locations colored black (the second 82, the fifth 88, and the sixth 90 storage location) contain a banknote of the appropriate denomination; whereas, those storage locations that are clear are empty.

It should be appreciated that the number of different denominations (or even currencies) that can be stored is a matter of choice for the system designer. Furthermore, the number of banknotes of a particular denomination to be stored within a set is also a design choice. In environments where very few high denomination banknotes are expected, but many low denomination banknotes are expected, then a set may be selected to comprise five one dollar bills, five five dollar bills, five ten dollar bills, three twenty dollar bills, one fifty dollar bill, and one hundred dollar bill. Thus, the size and composition of each set can be selected to match the anticipated mix of banknotes that will be received.

Figure 4:
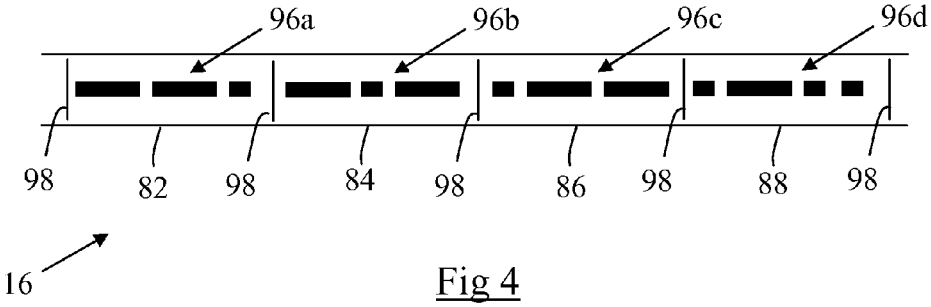
FIG. 4 is a pictorial diagram of the storage tape of FIG. 3, illustrating different calibration marks depicted on an outer surface of thereof.

Returning now to FIG. 3, and also referring to FIG. 4, which illustrates calibration marks 96 depicted on the storage tape 16, each storage location includes a calibration mark 96 on an outer surface of the storage tape 16 to identify the type of banknote stored at that location. Each calibration mark 96 is separated from its adjacent calibration marks by a divider line 98 that can be identified by the sensor 52.

The first calibration mark 96*a* shown in FIG. 4 is associated with a one dollar bill and comprises two long blocks and a short block. The second calibration mark 96*b* is associated with a ten dollar bill and comprises a long block, a short block, then a long block. The third calibration mark 96*c* is associated with a five dollar bill and comprises a short block, a long block, then a long block. The fourth calibration mark 96*d* is associated with a twenty dollar bill and comprises a short block a long block, a short block, then another short block. These long and short blocks are read by the sensor 52 and decoded so that the sensor 52 indicates to the controller 54 the dollar value associated with each storage location.

Figure 5:
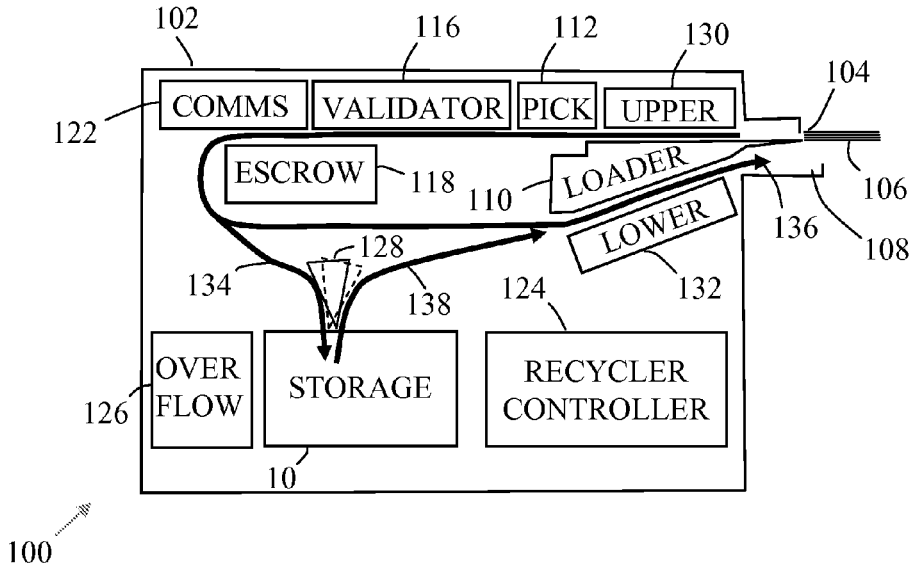
FIG. 5 is a simplified, schematic diagram of a media recycler including the media storage unit of FIG. 1.

Reference will now be made to FIG. 5, which is a simplified, schematic diagram of a media recycler 100 including the banknote storage unit 10.

The recycler 100 includes a chassis 102 onto which various parts are mounted. The recycler 100 further comprises: a bunch entry slot 104 into which a bunch of banknotes 106 can be deposited; a pocket (or tray) 108 from which sprayed banknotes can be removed; a bunch loader 110; a picker 112 aligned with the bunch loader 110 for removing individual banknotes from the bunch (or stack) of banknotes 106; a banknote validator (also called a bill validator) 116; an escrow 118 for temporarily holding validated banknotes until a customer confirms that he/she wants to complete the transaction; the banknote storage unit 10; a communications circuit board 122 for communicating with a self-service terminal (not shown) into which the recycler 100 may be installed; a recycler controller 124 for controlling the operation of the recycler 100; and a banknote overflow store 126 for receiving any banknotes that cannot be stored in the banknote storage unit 10 (for example, because the banknote storage unit 10 is full).

A pivoting diversion gate 128 is also provided to route banknotes from the escrow 118 to the banknote storage unit 10 when in a first (deposit) position (shown in FIG. 5 in solid line); and to route banknotes from the banknote storage unit 10 to the banknote entry slot 104 when in a second (dispensing) position (shown in FIG. 5 in broken line). The pivoting diversion gate 128 is activated by the recycler controller 124.

The recycler 100 includes a plurality of banknote transport sections, only some of which will be described herein. An upper sheet transport section 130 is located above the bunch loader 110 and adjacent the picker 112. A lower sheet transport section 132 is located beneath the bunch loader 110 and near the bunch entry slot 104.

The bunch loader 110 is used to transport deposited banknotes from the bunch entry slot 104 to the picker 112.

There are two different routes that can be taken by a banknote that is inserted into the recycler 100. The first route (the banknote storage route) is shown by arrow 134 and involves the banknote being picked from the bunch of banknotes 106, transported to the picker 112, moved past the validator 116 to be identified and validated, placed in the escrow 118, and from the escrow 118 transported into the banknote storage unit 10 when the customer confirms that the transaction should proceed.

The second route (the banknote return route) is shown by arrow 136 and involves the banknote being picked from the bunch of banknotes 106, transported to the picker 112, moved past the validator 116 to be identified and validated, placed in the escrow 118, and from the escrow 118 returned to the customer via the lower sheet transporter 132 and the pocket 108.

As is known in the art, whether a banknote is stored (that is, follows the first route 134 in this embodiment) or returned to the customer (that is, the second route 136 in this embodiment) depends on a number of factors, such as: whether the banknote is recognized, whether the banknote is validated, whether the customer cancels or confirms the transaction, and the like.

There is a third route (the banknote dispense route) 138 that is taken by a banknote that is dispensed from the recycler 100. The banknote is output from the banknote storage unit 10 and joins the latter part of the banknote return route 136.

Figure 6:
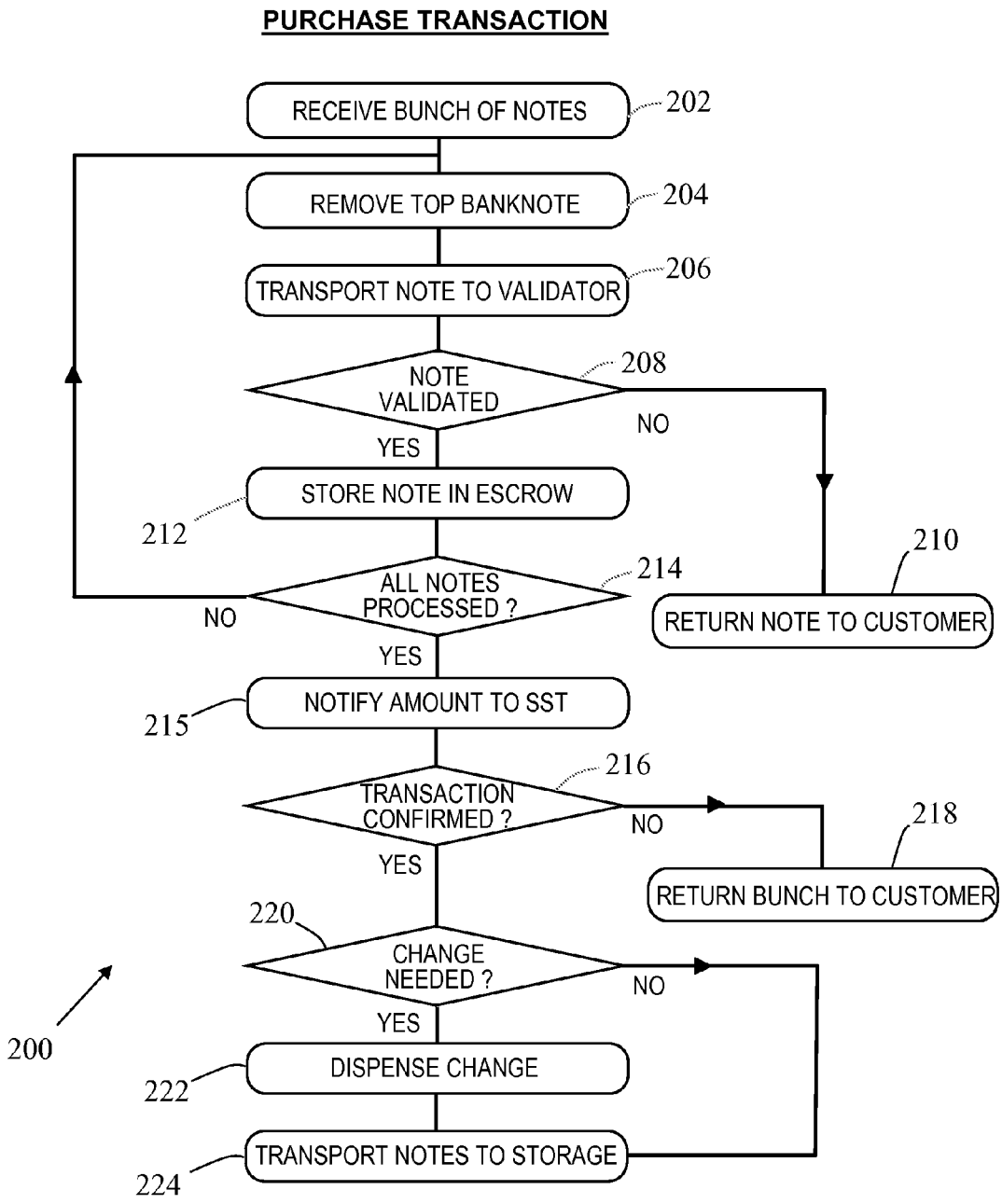
FIG. 6 is a flowchart illustrating steps involved in storing media items (in the form of banknotes) received as part of a purchase transaction.

The operation of the recycler 100, and particularly the banknote storage unit 10 therein, will now be described with reference to FIG. 6, which is a flowchart 200 illustrating steps involved in storing banknotes received as part of a purchase transaction. In this example, the recycler 100 is included in a self-service terminal (not shown) in the form of a retail self-checkout terminal.

In this example, a customer wishes to pay for items that total forty-five dollars, and places a bunch comprising two twenty dollar bills and a ten dollar bill in the banknote entry slot 104. The recycler 100 receives this bunch (step 202) and uses the upper sheet transport section 130 and bunch loader 110 to transport the bunch to the banknote picker 112.

The recycler 100 then strips off the top banknote (step 204) from the bunch. In this example, a ten dollar bill is on top, then a twenty dollar bill, then another twenty dollar bill.

The recycler 100 then transports the picked individual banknote to the banknote validator 116 (step 206) for validation (step 208).

If the first banknote (the ten dollar bill) is not validated, then it is returned to the customer (step 210) via the banknote return route 136 to the pocket 108.

If the first banknote (the ten dollar bill) is validated, then it is stored in the escrow 118 (step 212).

The recycler controller 124 then ascertains if there are any banknotes that still require processing (step 214). At this stage, there are a further two banknotes requiring processing, so steps 204 to 212 are repeated for these two banknotes.

When all of the banknotes have been processed there are three banknotes in the escrow 118 (assuming that no banknote has been returned to the customer). In this embodiment, the escrow 118 includes a rotary storage device (not shown) so that the first banknote inserted into the escrow 118 (the ten dollar bill) is the last banknote removed from the escrow 118. Using a rotary storage device in the escrow 118 maintains the order in which the banknotes are transported into the escrow 118, so that the recycler controller 124 knows the order that banknotes will be transferred to the banknote storage device 10.

Once all of the banknotes have been validated, the recycler controller 124 sends a signal to the SST (not shown) indicating the total value of banknotes that have been validated (step 215). The SST then presents an option to the customer to accept the transaction or to cancel the transaction.

Once the customer has made his/her selection, then the recycler 100 receives a signal from the SST notifying the recycler of that decision (step 216).

If the customer decides to cancel the transaction, then the recycler controller 124 returns the banknotes in the escrow 118 to the customer via the banknote return route 136 (step 218).

If the customer decides to proceed with the transaction, then the recycler controller 124 ascertains if the customer requires change (step 220).

In this example, the purchase price is forty-five dollars, and fifty dollars have been inserted, so the customer requires five dollars change. The recycler controller 124 proceeds to issue change (step 222), as will be described in more detail below.

Once the correct change has been dispensed, or if no change is required, then the recycler controller 124 stores the banknotes in the escrow 118 into the banknote storage unit 10 (step 224), as will be described in more detail below.

Figure 7:
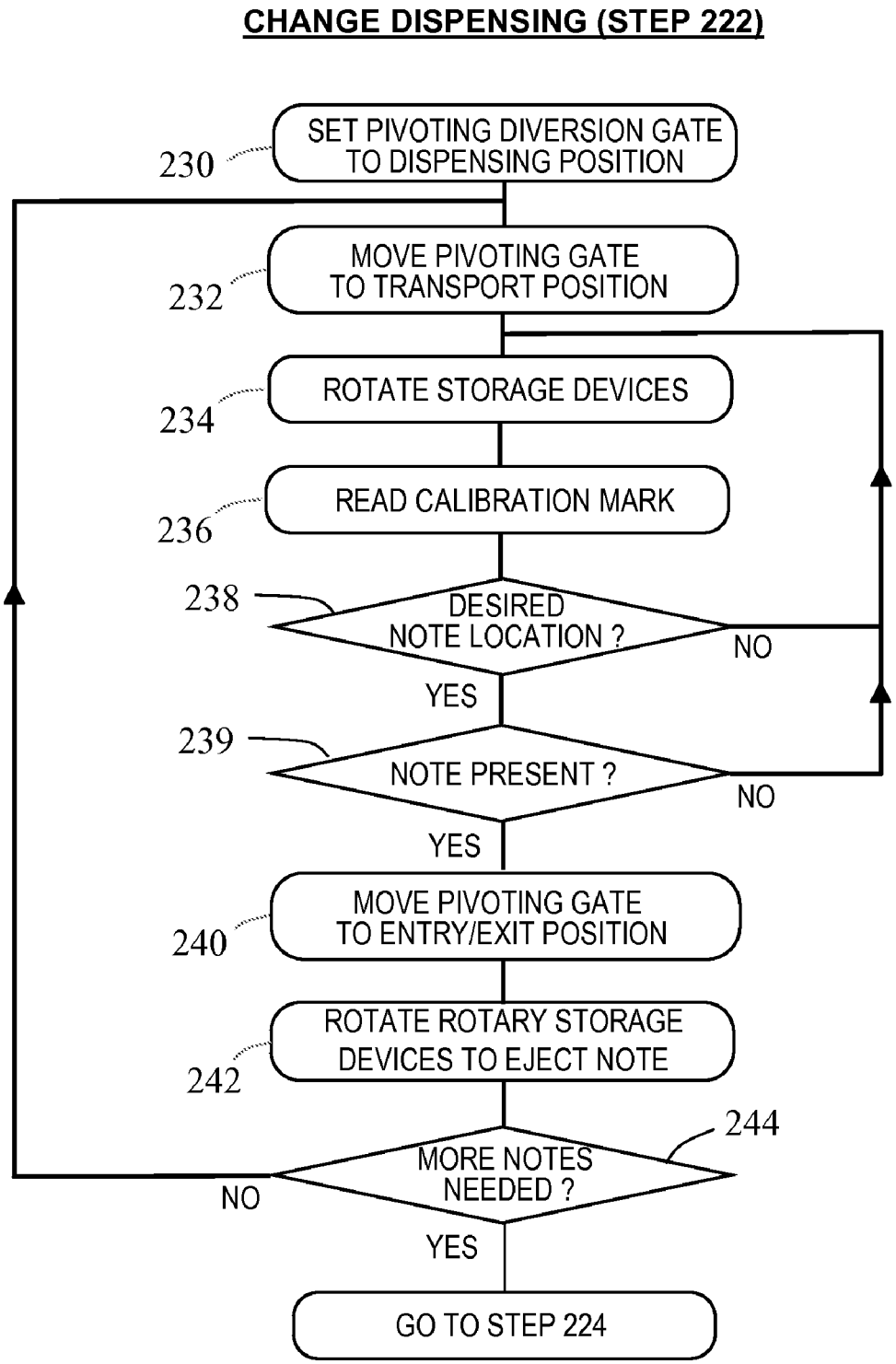
FIG. 7 is a flowchart illustrating sub-steps involved in one of the steps (dispensing change) of the flowchart of FIG. 6.

Reference will now be made to FIG. 7, which is a flowchart illustrating the sub-steps involved in the change dispensing step (step 222).

The recycler controller 124 sets the pivoting diversion gate 128 to the dispensing position (step 230), then the controller 54 moves the pivoting gate 42 to the transport position (step 232). This enables the storage tape 16 to be advanced or rewound without removing any banknotes from the banknote storage unit 10.

The controller 54 then activates the appropriate motors 50 to advance the storage tape 16 (step 234), that is, to unwind the storage tape 16 from the first rotary storage device 12 and onto the second rotary storage device 14. This involves rotating the first rotary storage device 12 anticlockwise, rotating the first auxiliary tape store 20 clockwise, rotating the second rotary storage device 14 anticlockwise, and rotating the second auxiliary tape store 26 clockwise.

As the storage tape 16 is moving, the sensor 52 reads the calibration marks on the outer surface of the storage tape 16 (step 236) until a calibration mark is sensed that corresponds to a storage location containing the banknote needed to provide change for the customer (step 238).

In addition to sensing the desired storage location, the sensor 52 also detects whether a banknote is actually stored at that location (since the location could be empty) (step 239).

The controller 54 is aware of the order of the storage locations on the storage tape 16, so it can advance or rewind the storage tape 16 to reach the desired location in the shortest possible time. In this example, if the calibration mark being read corresponds to a fifty dollar storage location (for example storage location 92 in the first set 76), then the controller 54 can advance the storage tape 16 by five storage locations to reach a five dollar bill storage location (in the second set 78). Alternatively, the controller 54 can rewind the storage tape 16 by three storage locations (to storage location 86 in the first set 76).

If there is no banknote currently stored at that location, then the controller 54 moves the storage tape 16 to the next storage location at which a five dollar bill may be stored.

Once the storage tape 16 has been moved to the correct storage location that includes a banknote (that is, a five dollar bill), the controller 54 moves the pivoting gate 42 to the entry/exit position (step 240), and then activates the motors 50 to dispense the banknote from the correct storage location to the banknote entry slot 104 via the banknote dispense route 138 (step 242).

If more banknotes are required to provide the correct change, then steps 232 to 242 are repeated as necessary.

Once the change has been dispensed, then the flow returns to step 224.

Figure 8:
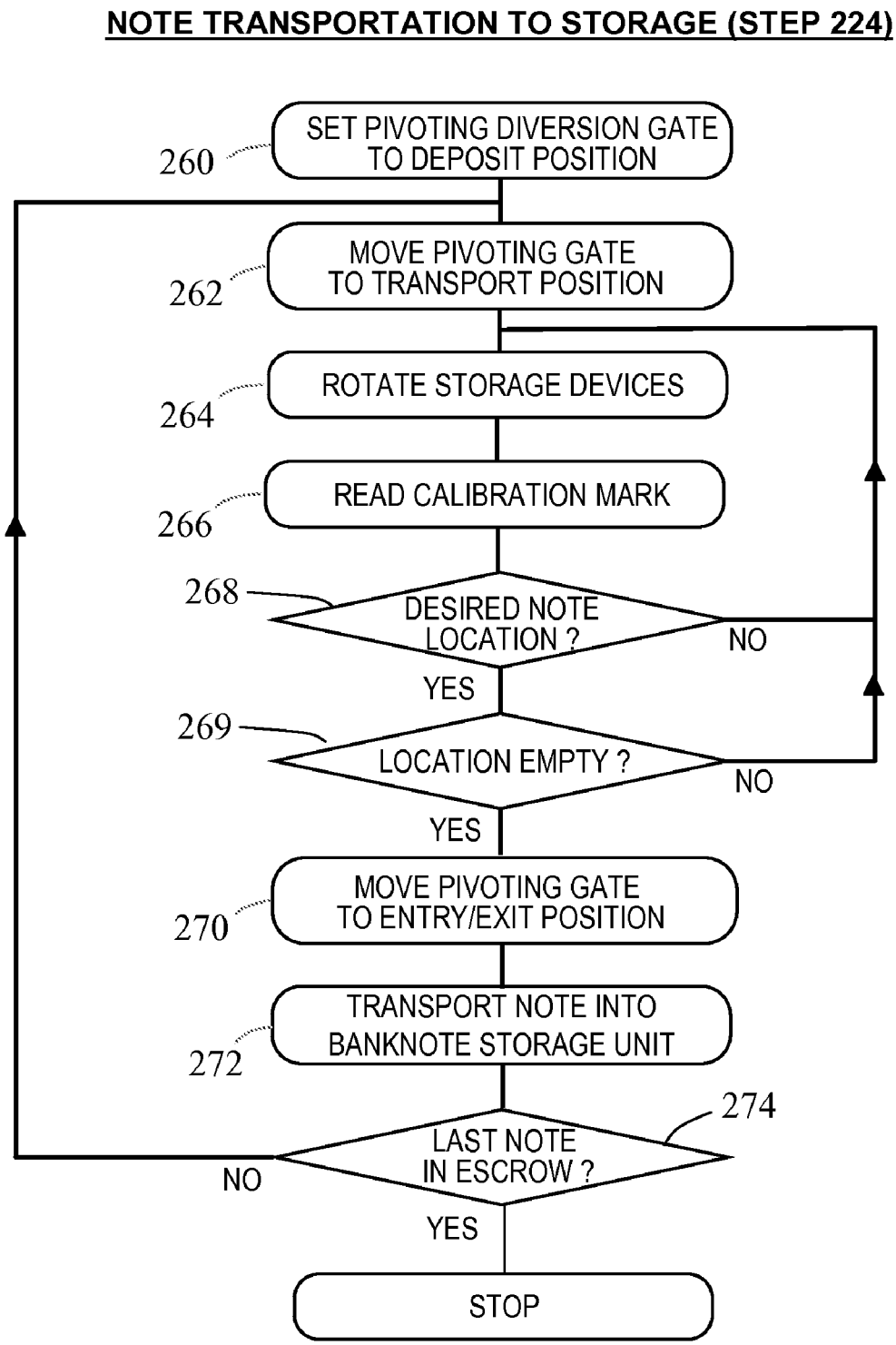
FIG. 8 is a flowchart illustrating sub-steps involved in another of the steps (transporting banknotes to storage) of the flowchart of FIG. 6.

Reference is now also made to FIG. 8, which is a flowchart illustrating the sub-steps involved in transferring banknotes from the escrow 118 into the banknote storage unit 10. As mentioned above, this is implemented after the transaction has been completed so that the banknote storage time does not adversely affect the transaction time.

The recycler controller 124 sets the pivoting diversion gate 128 to the deposit position (step 260), then the controller 54 moves the pivoting gate 42 to the transport position (step 262). This enables the storage tape 16 to be advanced or rewound without removing any banknotes from the banknote storage unit 10.

The controller 54 then activates the appropriate motors 50 to advance the storage tape 16 (step 264), that is, to unwind the storage tape 16 from the first rotary storage device 12 and onto the second rotary storage device 14. This involves rotating the first rotary storage device 12 anticlockwise, rotating the first auxiliary tape store 20 clockwise, rotating the second rotary storage device 14 anticlockwise, and rotating the second auxiliary tape store 26 clockwise.

As the storage tape 16 is moving, the sensor 52 reads the calibration marks on the outer surface of the storage tape 16 (step 266) until a calibration mark is sensed that corresponds to a storage location associated with the banknote that needs to be stored (step 268).

In addition to sensing the desired storage location, the sensor 52 also detects whether that storage location is empty or full (since a banknote may already be stored at that location) (step 269).

The first banknote requiring storage is the last banknote transferred to the escrow 118. In this example, the last banknote transferred to the escrow 118 was the twenty dollar bill.

The controller 54 is aware of the order of the storage locations on the storage tape 16, so it can advance or rewind the storage tape 16 to reach the desired location in the shortest possible time. In this example, if the first calibration mark being read corresponds to a fifty dollar storage location (for example storage location 92 in the first set 76), then the controller 54 can advance the storage tape 16 by six storage locations to reach a twenty dollar bill storage location (in the second set 78). Alternatively, the controller 54 can rewind the storage tape 16 by one storage location (to storage location 90 in the first set 76).

If there is a twenty dollar bill currently stored at that location, then the controller 54 moves the storage tape 16 to the next storage location at which a twenty dollar bill may be stored (for example, storage location 88).

Once the storage tape 16 has been moved to the correct empty storage location, the controller 54 moves the pivoting gate 42 to the entry/exit position (step 270), and then activates the transport section 60 to transport the twenty dollar bill from the escrow 118 to the banknote storage unit 10 (step 272).

The controller 54 then ascertains if there are any remaining banknotes in the escrow 118 (step 274). If there are, then the controller 54 repeats steps 262 to 274, as appropriate. If there are no more banknotes remaining in the escrow 118, then the flow stops because storage of the banknotes in the banknote storage unit 10 is complete.

It should now be appreciated that this embodiment provides a low cost recycler that is suitable for use in retail and other low cost environments.

Various modifications may be made to the above described embodiment within the scope of the invention, for example, in other embodiments, a recycler controller may perform the functions of both the storage controller 54 and the recycler controller 124.

In other embodiments, the pivoting gate 42 may be moveable between three positions: a transport position; an entry position; and an exit position. Alternatively, the three positions may comprise: a transport position, and two entry/exit positions, one entry/exit position where the pivoting gate is pivoted to the right, the other entry/exit position where the pivoting gate is pivoted to the left.

In other embodiments, the entry/exit position may be on the opposite side (that is, nearer the second rotary storage device 14 than the first rotary storage device 12) than in the above embodiment.

In other embodiments, the set 76 may be differently configured to the set described above. For example, a greater number of banknotes may be included.

In other embodiments, media items other than, or in addition to, banknotes may be stored.

In other embodiments, a different scheme of calibration marks may be used than that described above.

In other embodiments, a different type of escrow may be used than that described above, for example, a bunch escrow may be used.

In other embodiments, the controller 54 may not be programmed with the order of banknotes in a set; the calibration marks may contain all information required to identify what banknote is stored at each storage location.

In other embodiments, the calibration marks may comprise a different encoding scheme; for example, a different optical encoding scheme, or a non-optical encoding scheme. In other embodiments, the storage tape may comprise audio tape and an audio encoding scheme may be used.

In other embodiments, the second route (the banknote return route) involves the banknote being picked from the bunch of banknotes 106, transported to the picker 112, moved past the validator 116 to be identified and validated, and returned to the customer via the lower sheet transporter 132 without passing through the escrow 118.

In the above embodiment, the sensor 52 is located at a position corresponding to a storage location entry/exit point, so that when a calibration mark is read, the storage tape is aligned for receiving a banknote, or having a banknote removed. In other embodiments, a separate mark may be provided to indicate the entry/exit point for each storage location, so that when the separate mark is aligned with the sensor 52, the storage tape is aligned for receiving a banknote, or having a banknote removed.

In other embodiments, the auxiliary storage tapes may not be required, so that only a single storage tape is used. In such embodiments, one or more skid plates may be used to guide the media items into the rotary storage devices and media items may be captured between an inner surface of the fed storage tape and an outer surface of the previous wrap of the storage tape on rotary storage device.

In other embodiments, an escrow may not be used; instead, all notes may be stored on the rotary storage devices, and removed in the event that the customer cancels the transaction, or the transaction needs to be reversed for some other reason.

In other embodiments where an escrow is not used, an extended transport may be provided between the media validator and the rotary storage devices so that all media items in a bunch may be located within the extended transport. In this way, the extended transport can be used for temporarily storing media items instead of an escrow.

In other embodiments, each calibration mark may be unique, so that each storage location can be uniquely identified. This enables the controller to move directly to a specific storage location. A sensor may be provided to ascertain if a media item is present in that storage location.

In other embodiments, the algorithm used for seeking a particular media item for a dispense transaction, or for seeking a storage location for storing a media item for deposit, may include an optimization routine for optimizing media item distribution on the storage tape. Optimization may be implemented (i) to enhance speed of subsequent removal or storage functions (as part of a dispense or deposit transaction), (ii) to minimize the accumulated formation of permanent curvature on media items by selecting media items based on how long they have been stored, (iii) to minimize wear to the mechanism, and/or (iv) to ensure the shortest time required to fetch media items.

Although the above embodiment described the example of a bunch of media items being deposited, it will be apparent that an individual media item may be deposited and/or dispensed.

In other embodiments, multiple repositories may be provided to store media items that are not stored in the rotary storage devices. These repositories may be dedicated for particular media items, such as known counterfeits, suspect banknotes, denominations that will not be dispensed (such as high value denominations), media items of poor quality, and the like.

In other embodiments, calibration marks for the start and end of each storage location may be provided to allow detection of media item movement within the storage location. If a media item is outside a defined tolerance (that is, too close to one of the start and end calibration marks for a single storage location) then an error may be generated by the controller. The controller may also facilitate a recovery action, such as removing and re-locating the media item.

The steps of the methods described herein may be carried out in any suitable order, or simultaneously where appropriate. The methods described herein may be performed by software in machine readable form on a tangible storage medium or as a propagating signal.

The terms "comprising", "including", "incorporating", and "having" are used herein to recite an open-ended list of one or more elements or steps, not a closed list. When such terms are used, those elements or steps recited in the list are not exclusive of other elements or steps that may be added to the list.

Unless otherwise indicated by the context, the terms "a" and "an" are used herein to denote at least one of the elements, integers, steps, features, operations, or components mentioned thereafter, but do not exclude additional elements, integers, steps, features, operations, or components.

What is claimed is:

1. A media storage unit for a media recycler, the media storage unit comprising:

a first rotary storage device;

a second rotary storage device aligned with the first rotary storage device;

storage tape for storing a plurality of different types of media items, the storage tape being wound around each of the first and second storage devices and including a plurality of media storage locations associated with the different types of media items including different marks disposed therealong corresponding to the different types of media items;

a sensor for detecting the marks;

an entry/exit port between the first and second rotary storage devices through which media items can be inserted or removed; and a controller operable to rotate either the first or second storage devices to move the storage tape forwards or backwards while sensing the marks to locate either (i) one of the types of media items for a dispense transaction, or (ii) a space on the storage tape associated with one of the types of media items for a deposit transaction.

2. A media storage unit according to claim 1, further comprising first and second auxiliary tape stores; the first auxiliary tape store including first auxiliary tape wound around the first auxiliary tape store and extending to, and wound around, the first rotary storage device, so that the media items are stored on the first rotary storage device between the first auxiliary tape and the storage tape; and the second auxiliary tape store including second auxiliary tape wound around the second auxiliary tape store and extending to, and wound around, the second rotary storage device, so that the media items are stored on the second rotary storage device between the second auxiliary tape and the storage tape.

3. A media storage unit according to claim 2, wherein the entry/exit port includes a gate moveable by the controller between two positions: (i) a transport position, at which the gate is parallel to a portion of the storage tape adjacent the gate, and (ii) an entry/exit position, at which the gate is transverse to the portion of the storage tape adjacent the gate.

4. A media storage unit according to claim 2, wherein the entry/exit port includes a gate moveable by the controller between three positions: (i) a transport position, at which the gate is parallel to a portion of the storage tape adjacent the gate, (ii) an entry position, at which the gate is transverse to the portion of the storage tape adjacent the gate and a lower part thereof is closer to the first rotary storage device than to the second rotary storage device, (iii) an exit position, at which the gate is transverse to the portion of the storage tape adjacent the gate and a lower part thereof is closer to the second rotary storage device than to the first rotary storage device.

5. A media storage unit according to claim 1, wherein the entry/exit port includes a plurality of rollers for guiding the storage tape, the first auxiliary tape, and the second auxiliary tape, and maintaining these tapes in tension.

6. A media storage unit according to claim 1, wherein the controller is arranged to store a mapping of the types of media items stored at the different marks.

7. A media recycler including the media storage unit according to claim 1.

8. A media recycler according to claim 7, further comprising a motor for rotating the rotary storage devices and the auxiliary tape stores.

9. A media recycler according to claim 7, further comprising a media validator.

10. A self-service terminal including a media recycler according to claim 9.

11. A method of storing media items in a media recycler, the method comprising:

receiving a media item from a media item validator, the media item being of one type of a plurality of different types of media items;

rotating either a first rotary storage device or a second rotary storage device aligned with the first rotary storage device to move storage tape wound around each of the first and second storage devices;

wherein the storage tape includes a plurality of media storage locations associated with the plurality of different types of media items, and wherein the media storage locations include different marks disposed along one side of the storage tape corresponding to the different types of media items;

sensing the marks disposed along the one side of the storage tape to identify one of the media storage locations on the storage tape corresponding to the one type of media item associated with the received media item;

aligning the one media storage location with an entry/exit port; and inserting the received media item into the entry/exit port.

12. A method according to claim 11, wherein the step of inserting the received media item into the entry/exit port comprises the further step of moving a gate in the entry/exit port to an entry position at which the gate is transverse to a portion of the storage tape adjacent the gate and a lower part thereof is closer to the first rotary storage device than to the second rotary storage device.

13. A method according to claim 11, wherein the step of rotating either a first rotary storage device or a second rotary storage device further comprises: moving a gate in the entry/exit port to a transport position at which the gate is parallel to a portion of the storage tape adjacent the gate, so that media items stored in the first rotary storage device may be transferred past the entry/exit port to the second rotary storage device.

14. A method of dispensing media items from a media recycler, the method comprising:

rotating a first rotary storage device and/or a second rotary storage device aligned with the first rotary storage device to move storage tape wound around each of the first and second storage devices;

wherein the storage tape includes a plurality of media storage locations associated with a plurality of different types of media items, and wherein the media storage locations include different marks disposed along one side of the storage tape corresponding to the different types of media items;

sensing the marks disposed along the one side of the storage tape to identify one of the media storage locations on the storage tape corresponding to one type of media item required to fulfill a dispense transaction;

aligning the one media storage location with an entry/exit port; and transporting a media item of the one type stored at the one media storage location through the entry/exit port towards a dispense slot.

* * * * *